US005309627A

United States Patent [19]

Burrage et al.

[11] Patent Number: 5,309,627

[45] Date of Patent: May 10, 1994

[54] APPARATUS FOR MAKING A TRANSFORMER CORE OF NON-CIRCULAR CROSS-SECTION

[75] Inventors: Lawrence M. Burrage, South Milwaukee; James V. White, Waukesha; John F. Baranowski, Franklin; Gary L. Goedde, Racine, all of Wis.

[73] Assignee: Cooper Power Systems, Inc., Houston, Tex.

[21] Appl. No.: 635,675

[22] Filed: Dec. 28, 1990

[51] Int. Cl.[5] ..... H01F 41/02

[52] U.S. Cl. ..... 29/738; 29/564.6; 29/609; 242/7.07

[58] Field of Search ..... 29/609, 605, 606, 738, 29/564.6; 242/7.07; 336/212, 213, 216, 217, 234

[56] References Cited

U.S. PATENT DOCUMENTS 1,200,190 10/1916 Hahnemann .
2,011,697 8/1965 Vogt .
2,542,806 2/1951 Ford et al. .
3,162,391 12/1964 Westcott et al. .
3,802,239 4/1974 Karmann et al. .
4,141,235 2/1979 Ishihara .
4,413,406 11/1983 Bennett et al. .
4,467,632 8/1984 Klappert .
4,513,596 4/1985 Usher .
5,093,981 3/1992 Ballard et al. ..... 29/609

*Primary Examiner*—Carl E. Hall
*Attorney, Agent, or Firm*—Burns, Doane, Swecker & Mathis

[57] ABSTRACT

A transformer core of non-circular cross-section, preferably rectilinear, is formed by successively wrapping individual packets of core strips around a stationary mandrel of non-circular cross-section. Each packet is wrapped by a pair of yieldably biased rollers which follow the contour of the mandrel. As the packet is being wrapped, pressure pads are extended to hold the packet against the mandrel. The pressure pads are momentarily retracted to accommodate return movement of the roller wipers to receive a subsequent packet. The ends of the packet form a joint at the top of the mandrel. The positions of successive packets can be changed to vary the location of the joint in order to form a desired joint pattern.

23 Claims, 5 Drawing Sheets

Fig. 5
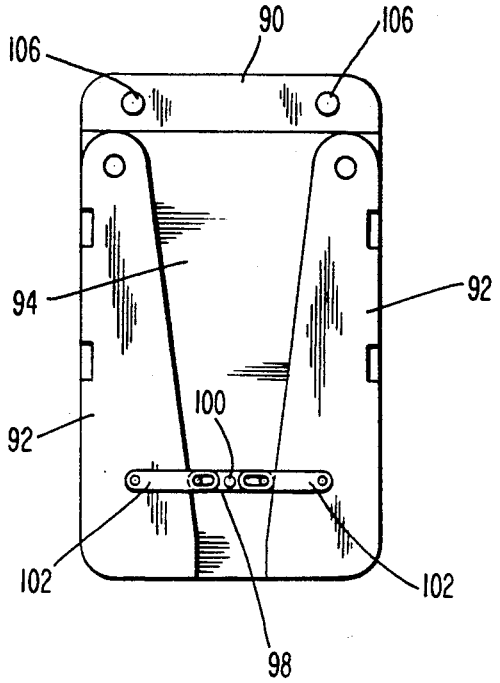
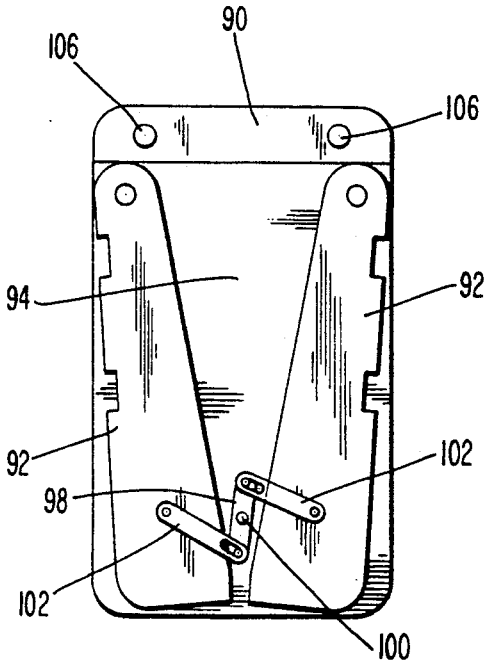
Fig. 6
Fig. 7
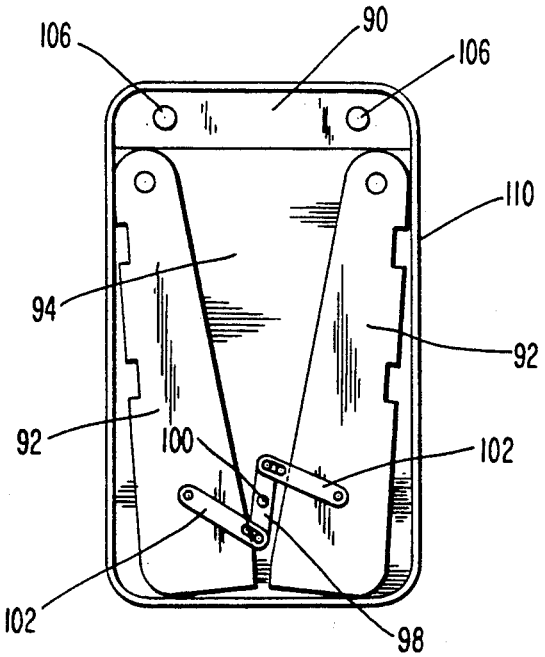

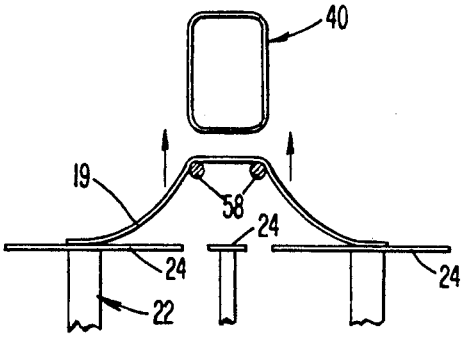
Fig. 8
Fig. 9
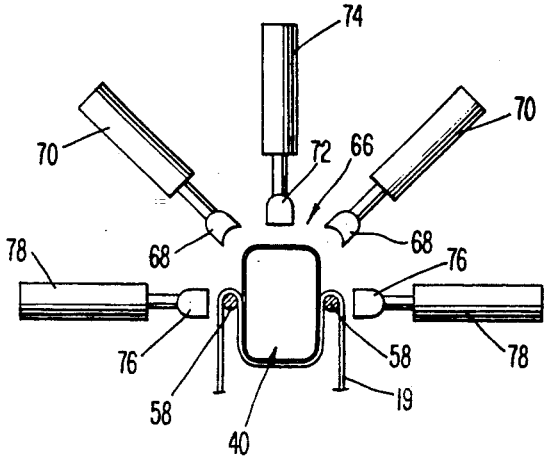
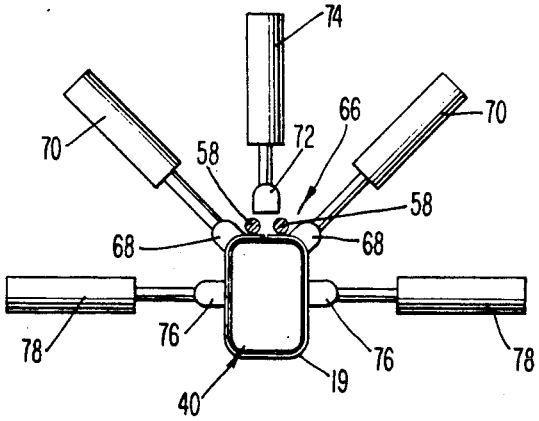
Fig. 10
Fig. 11
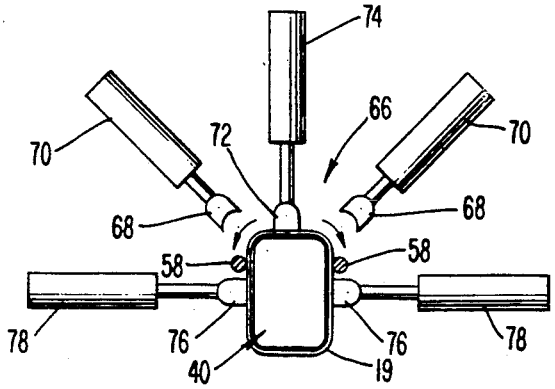

APPARATUS FOR MAKING A TRANSFORMER CORE OF NON-CIRCULAR CROSS-SECTION

BACKGROUND OF THE INVENTION

The present invention relates to apparatus for the manufacture of transformer cores, and, in particular, the manufacture of amorphous alloy cores having a non-circular cross section.

It has been conventional to manufacture transformer cores of non-circular cross section, e.g., quadrilateral cross section, by making a core of circular cross section and then deforming that core into the quadrilateral shape. In particular, amorphous alloy material in strip form, i.e., either a continuous strip or precut strips, is wrapped around a rotating circular cylindrical mandrel and then banded as described in U.S. Pat. Nos. 4,413,406 and 4,467,632. Prior to being annealed, the thus-formed core is squeezed at the top, bottom, and sides into the desired quadrilateral shape such as a rectangular shape.

Shortcomings of such a manufacturing technique involve the fact that the deforming of the core into the quadrilateral shape increases the tensile stresses therein, particularly at the corner regions, and also increases the compressive loads in the corner regions. Also resulting from the core deformation is a greater possibility of interlaminar bonding occurring during the annealing step, as well as increased core loss and the need for greater exciting power.

Moreover, the use of a rotating mandrel complicates the manufacturing efforts because of the difficulties involved in forming a precise overall joint construction in either the yoke or leg portion of the core as the precut strips are being assembled upon the rotating mandrel. Moreover, if the core is formed by winding a continuous strip around a rotating mandrel, then it becomes necessary to apply the electrical coils (windings) to the core either during the core-shaping operation or thereafter by cutting the core. The former step is complicated and inefficient, and the latter step can lead to increased core loss. Those shortcomings thus apply to proposed techniques for making rectangular cores discussed in U.S. Pat. Nos. 2,011,697; 2,542,806; and 3,162,391, wherein a continuous strip of core material is Wound around a rotating rectangular mandrel.

It would, therefore, be desirable to provide methods and apparatus for making transformer cores of non-circular cross section which eliminate or alleviate the above-described shortcomings.

SUMMARY OF THE INVENTION

The present invention involves apparatus and methods for making a transformer core. The apparatus comprises a stationary mandrel having a non-circular cross-sectional perimeter. A positioning mechanism positions a packet of metallic strips adjacent the mandrel. A wrapping mechanism urges a section of the packet against the mandrel and wraps a remaining section of the packet around the non-circular perimeter thereof so that opposite ends of the packet form a joint. A holding mechanism holds the packet against the mandrel while the wrapping mechanism receives successive packets from the positioning mechanism.

Preferably, the mandrel is collapsible to facilitate removal of a core therefrom. It is also preferable that the mandrel comprise a top portion and collapsible side portions, wherein the top portion is removable from the side portions along with the core.

The wrapping mechanism preferably comprises yieldably biased elements which follow the contour of the mandrel periphery while pressing the packet thereagainst.

The holding mechanism preferably comprises pressure pads which can be extended against the packet. The pressure pads are capable of being momentarily sequentially retracted in order to permit the wrapping mechanism to return to a position for receiving successive packets to be wrapped.

A preformed base layer of stiff material is mounted on the mandrel periphery thereof in order to form a surface upon which the packets are wound.

The method according to the present invention comprises the steps of positioning a packet of metallic strips adjacent a stationary mandrel having a non-circular cross-sectional sectional perimeter. A section of the packet is contacted against the mandrel, and a remaining section of the packet is wrapped around the non-circular perimeter of the mandrel so that opposite ends of the packet form a joint. The wrapped packet is held against the perimeter. The positioning, contacting, wrapping, and holding steps are repeated with successive packets until a core of desired thickness is obtained. The core is then banded and removed from the mandrel.

Preferably, the joints of successively wrapped packets are positioned at different locations relative to the joints of predetermined packets in order to form a desired joint pattern in the core.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 5 is a schematic end view of a mandrel according to the present invention, with collapsible side plates thereof oriented in an outward, non-collapsed position;

FIG. 6 is a view similar to FIG. 5 after the side plates have been swung inwardly to a collapsed position;

FIG. 7 is a view similar to FIG. 6 depicting a preformed base layer being mounted on the mandrel;

FIG. 8 is a schematic elevational view depicting a packet being raised from a platform toward a mandrel;

FIG. 9 is a view similar to FIG. 8 depicting the packet in the process of being wrapped onto the mandrel;

FIG. 10 is a schematic end view of the mandrel depicting a packet being held in position by pressure pads; and FIG. 11 is a view similar to FIG. 10 showing corner pressure pads being retracted to permit return movement of the wrapping mechanism toward a packet-receiving position.

DETAILED DESCRIPTION OF A PREFERRED EMBODIMENT OF THE INVENTION

Figure 1:
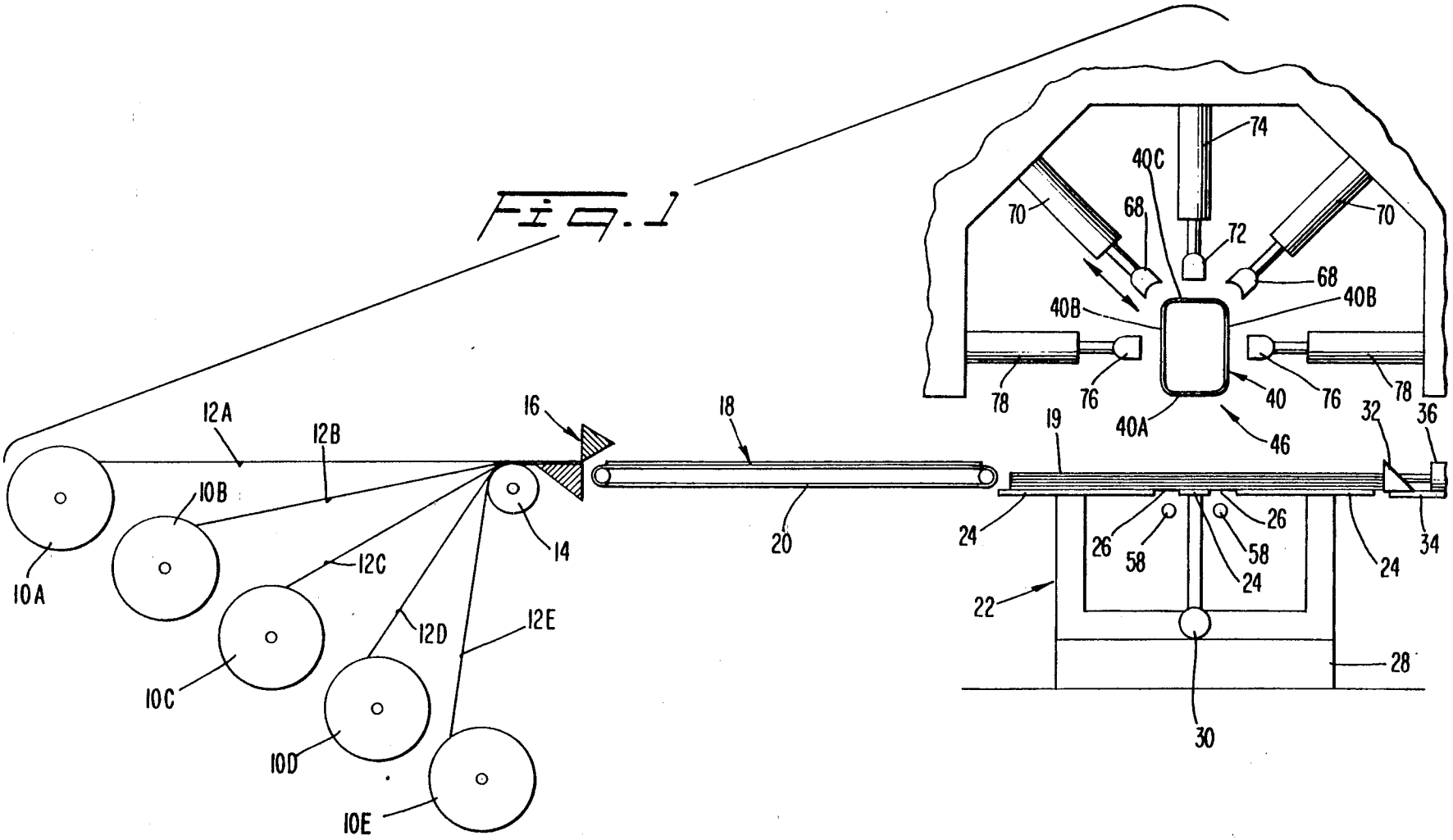
FIG. 1 is a schematic side elevational view of a core forming apparatus according to the present invention.
Figure 2:
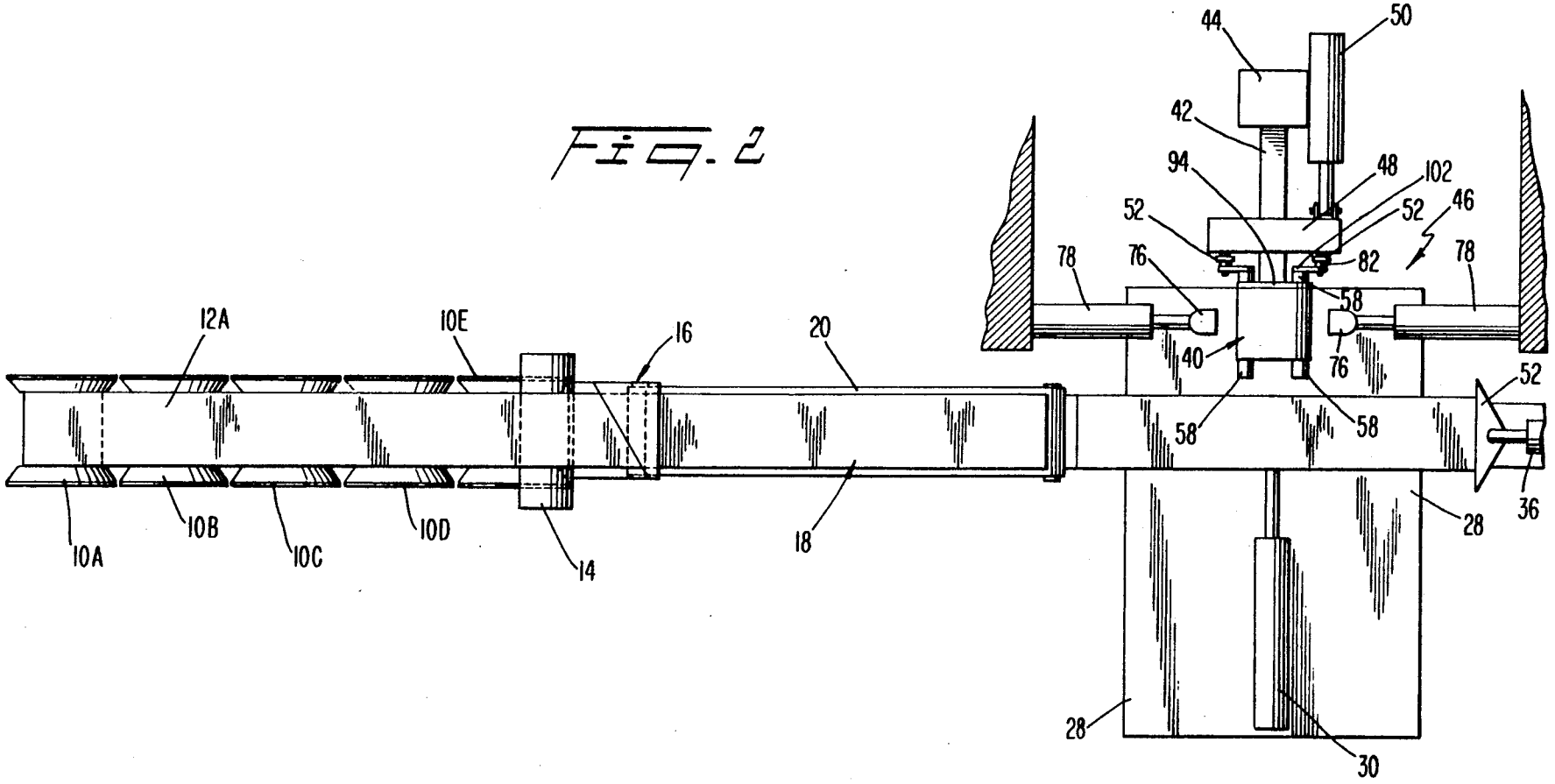
FIG. 2 is a schematic plan view of the apparatus depicted in FIG. 1.

Depicted schematically in FIG. 1 is an apparatus for making a transformer core according to the present invention. The apparatus comprises an arrangement of supply reels 10A–10E carrying strip material 12A–12E. The number of strips used can range from 1 to 1,000, but preferably 4 to 100 strips are used. Any suitable strip material can be used, such as strips of amorphous metal alloy or transformer grade silicon iron for example. The strips 12A–12E are fed over an idler roll 14 and then cut by a conventional shearing mechanism 16 to form a lamination 18 of strips (e.g., five strips). The shearing mechanism can be of the intermittent or continuous type.

Successively formed laminations are fed by a conveyor belt 20 to a platform 22 to form a packet 19 of laminations thereon. The platform 22 is interrupted, i.e., the table comprises a plurality of table sections 24 which are spaced apart to form gaps 26 therebetween. The platform 22 is slidably mounted on a guide 28, and is displaced laterally thereon by means of a fluid driven ram 30.

Situated at a trailing end of the platform is a stop 32 which is adjustably mounted on a frame 34 for movement toward and away from the platform by any suitable mechanism, such as a fluid ram 36. The stop 32 defines the position of the corresponding end of the packet and thereby determines the location of the joint between the ends of the packet following a wrapping procedure, as will become apparent. The position of the stop 32 can be determined by a programmed control mechanism which controls the ram 36. A changing of the stop position for successive packets will permit a desired joint pattern to be generated. Any conventional type of packet joint can be used, such as a butt joint, an overlapped joint, and a gapped joint (wherein the packet ends are spaced apart) for example, or a combination thereof. The joints can be arranged in any suitable pattern, such as echelon, chevron, "M" and "W" patterns. Preferably, overlapped joints in an echelon pattern are used.

Figure 3:
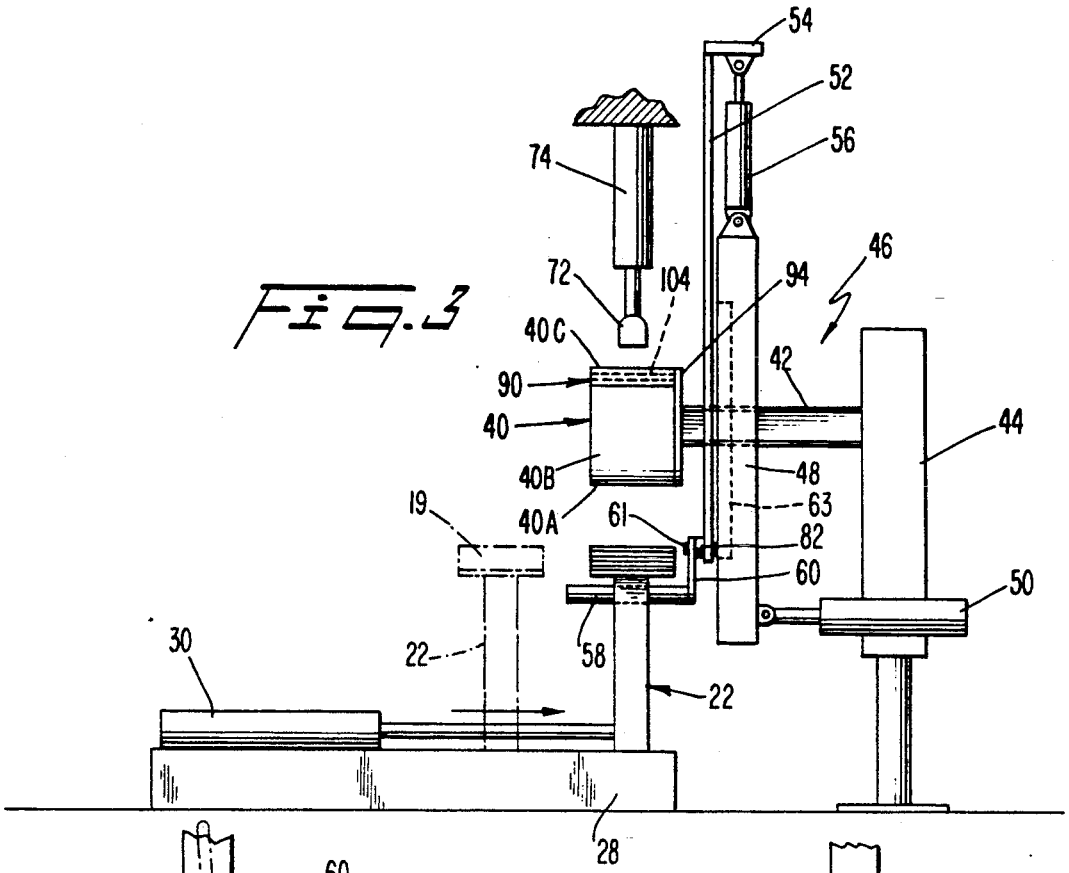
FIG. 3 is a side elevational view of a wrapping mechanism according to the present invention.

After a packet 19 of desired thickness is formed, the platform 22 is moved laterally by the ram 36 from a lamination-receiving position (shown in phantom in FIG. 3) to a winding position beneath a stationary mandrel 40 (shown in solid lines in FIG. 3). The mandrel 40, the construction of which will be described hereinafter in greater detail, has a cross-sectional perimeter of quadrilateral shape, i.e., a perimeter comprised of a horizontal bottom 40A, two vertical sides 40B, and a horizontal top 40C. The mandrel is mounted on a beam 42 projecting from a support 44.

Situated adjacent the mandrel 40 is a wrapping mechanism 46 comprising a carrier 48 which is slidable horizontally along the bar 42 by means of a fluid ram 50. The carrier 48 carries a lifting mechanism in the form of a pair of vertical legs 52 which are interconnected adjacent their upper ends by a horizontal bar 54. Connected to the horizontal bar 54 is a fluid ram 56 which is mounted on the carrier 48. By reciprocating the ram 56, the legs 52 can be raised relative to the mandrel.

At its lower end, each vertical leg 52 carries a packet-wiping device in the form of a roller 58. Each roller is rotatably connected to the end of a swinging arm 60 which is pivotably mounted to a respective leg 52 by means of a pin 61. A torsion spring 62 biases each arm 60 to a neutral position wherein the arm extends downwardly toward a center plane P of the mandrel. The torsion spring could comprise a strip of spring material, one end of which is connected to the arm 60 and the other end of which is clamped to the leg 52. The clamp can permit the length of the strip to be adjusted whereby the biasing force can also be adjusted.

The pins extend through the legs 52 and lie within respective vertical slots 63 formed in a front face of the carrier 48.

In their neutral positions, the rollers 58 are adapted to travel vertically through the gaps 26 formed in the platform 22. Thus, when the carrier 48 is displaced forward by the ram 50, and the arms 52 are in their lowered positions, the rollers 58 will underlie the gaps 26 and a packet 19 lying on the platform 22. Also, the rollers 58 will underlie the bottom 40A of the mandrel.

Accordingly, by then raising the arms 52, the rollers 58 will pass through the gaps 26, and lift the packet 19 (see FIG. 8). The upper ends of the arms 52 can be loosely connected to the bar 54, with the lower ends of the arms 52 being guided for movement by the presence of the pins 61 within the vertical slots 63. Eventually, a central section of the packet will be raised into contact with the bottom 40A of the mandrel, and the remaining section of the packet, i.e., the opposite end sections, will hang downwardly. Upon further raising of the legs 52, the torsion springs 62 acting upon the arms 60 will yield, allowing the arms to pivot about their pivot connections with the legs 52. As a result, the rollers will follow the perimeter of the mandrel, while gradually displacing the remainder of the packet 19 into contact with that perimeter (see FIG. 9). Eventually, the opposite ends of the packet become disposed adjacent another (e.g., butting, overlapped or gapped) to form a joint at the joint region 66 of the transformer (FIG. 10), which is preferably but not necessarily, disposed about midway along the top 40C of the mandrel. As noted earlier, overlapped joints in an echelon pattern are preferred.

After the rollers 58 have passed the upper corner regions of the mandrel, a pair of corner pressure pads 68 having curved pressing faces ar brought into engagement with the packet 19 to hold the packet snugly against those corner regions. The pressure pads 68 are preferably mounted at the ends of actuators, such as fluid rams 70.

Once the rollers 58 have reached the joint region 66, the direction of movement of the legs 52 is reversed, whereby the legs 52 are caused to descend. As a result, the rollers 58 move outwardly toward the upper corners of the mandrel. Immediately thereafter, an upper pressure pad 72 having a flat pressing face is lowered by a fluid ram 74 onto the opposing ends of the packet 19 to hold those ends in place.

When the rollers 58 reach the upper corners, the corner pressure pads 68 are momentarily retracted to allow the rollers to continue their downward movement.

It may also be desirable to provide side pressure pads 76 actuated by fluid rams 78 for pressing the packet against the vertical sides 40B of the mandrel to maintain the desired density of the core. Those side pressure pads would also be momentarily retracted to permit downward travel of the rollers.

It would also be possible to provide pressure pads for engaging the bottom of the wound packet, although such pads are not depicted. Those bottom pressure pads would be useful in the forming of large cores.

It will be appreciated that the relative movements of the legs 52 and pressure pads can be synchronized by a suitable computerized control mechanism.

While the wrapped packet is held in place against the mandrel by the pressure pads, the rollers travel downwardly to receive the next packet which was formed during the ascent of the previous packet, and thereafter the above-described wrapping sequence is repeated.

As noted earlier, the location of the stop 32 is changed for successive packets, whereby the positions of the packets relative to the mandrel are changed. As a result, the joint of each packet will be offset relative to that of the previously wrapped packet. The joints can be arranged in any desired joint pattern, as noted earlier.

After a sufficient number of packets have been wrapped to bring the core to its desired thickness, a band 80 is wrapped around the core. The ends of the band are then buckled together in the usual fashion.

The thus-formed core is then separated from the mandrel by partially collapsing the outer periphery of the mandrel (in a manner to be hereinafter explained) and lifting the core from the mandrel.

The mandrel 40 comprises a top plate 90 and a pair of side plates 92 (see FIGS. 5 and 6) which are mounted on a stationary support frame 94 (see FIG. 3) carried at the end of the beam 42. The side plates 92 are pivotably connected at their upper ends to the frame 94 by horizontal pivot pins 96 and are pivotably movable by a linkage which interconnects the side plates. That linkage comprises an actuator bar 98 which is mounted on a drive shaft 100 carried by the frame 94. A motor (not shown) carried by the frame rotates the drive shaft and the bar 98 about the axis of the drive shaft, which axis extends parallel to the axis of rotation of the pivot pins 96. Links 102 pivotably interconnect the ends of the bar 98 with respective ones of the side plates 92, so that in response to rotation of the bar 98 (counterclockwise rotation in FIG. 6), the side plates will be pivoted toward one another to thereby collapse the mandrel periphery.

The top plate 90 is removably mounted on the frame 94 in any suitable manner. For example, the frame 94 may carry parallel horizontal pins 104 (see FIG. 3) which extend part way through parallel horizontal holes 106 formed in the top plate 90. Thus, the outer portions of the holes 106 are free to receive parallel pins of a lifting device (not shown) for removing the top plate form the frame 94. The pins 104 can be retractable in any suitable fashion to permit the pins of the lifting device to fully enter the holes 106. The pins of the frame 94 and the lifting device can be of the radially expandable type to tightly engage the inside surfaces of the holes 106, whereby the top plate 90 will be constrained for movement with those pins.

Thus, it will be appreciated that once a core has been wrapped and banded, the side plates 92 can be pivoted toward one another to collapse the mandrel perimeter, and a lifting device can be connected to the top plate for removing the core.

In order to properly define an inside border of the core, a base layer 110 (see FIG. 7) is mounted around the exterior of the mandrel prior to the initiation of a core-wrapping procedure. The base layer 110 can be of single-piece or double-piece construction. Preferably, the base layer is formed of an electrically insulative material although it could be formed of transformer grade silicon iron. If of one-piece construction, the layer could be spot welded at its ends. If of two-piece construction, the ends of the base layer would be removably joined by two suitable interlocking structures.

It will be appreciated that it is possible to replace the mandrel with a mandrel of different size and/or shape to form a different core.

After a core has been formed, it is removed and properly treated prior to receiving one or more coils (not shown). In order to effect the mounting of the coils, the base layer 110 could be cut (or unlocked in the case of a two-piece base layer), and the ends of the base layer would be straightened (i.e., separated) in order to create a space in which the coil(s) could be wound.

The above-described mechanism is suitable for use with a shearing mechanism of the intermittent feed type, i.e., wherein the packet-forming operation is suspended during the period wherein the platform is shifted to a position beneath the mandrel. However, in the case of a shearing mechanism 16 of the continuous feed type, it is necessary to be able to continuously receive laminations from the shearing mechanism. This could be achieved by providing two side-by-side platforms, one platform being aligned with the shearing mechanism, and the other platform disposed beneath the mandrel. A transfer mechanism such as a pusher arm would be provided to transfer a packet from the first platform to the second platform.

Alternately, a pair of platforms could be provided having alternating table sections, whereby the interrupted table sections of each platform "mesh" horizontally with the table sections of the other platform. Thus, when one platform is laterally shifted with a packet carried thereon, the other platform would remain aligned with the shearing mechanism. Either or both of the platforms could be made laterally shiftable.

IN OPERATION, the core strip material 12A–12E is fed to the shearing mechanism 18 which cuts the strip material into a series of laminations 18. The conveyor 20 stacks a predetermined number of laminations onto a platform table 24 to form a packet of strips 19. The location of the leading end of the packet is determined by the position of the adjustable stop 32.

Figure 4B:
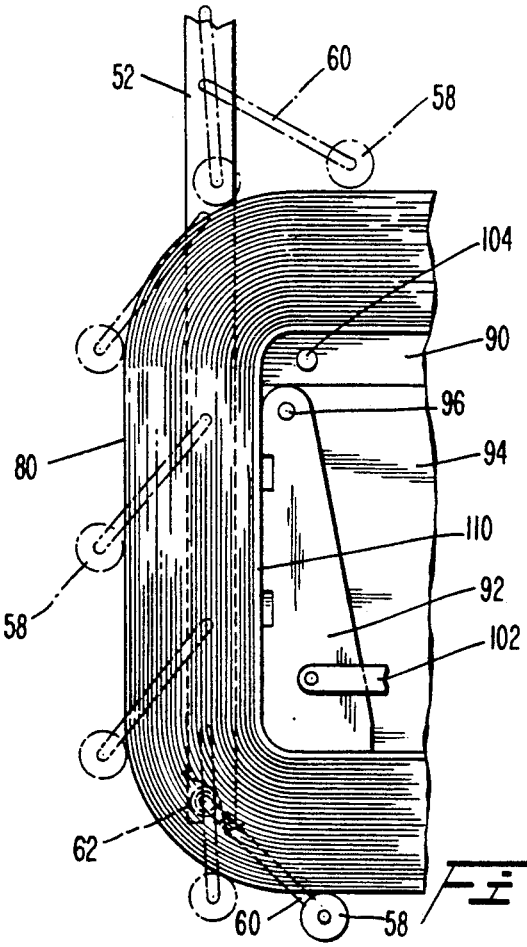
FIG. 4B is a view similar to FIG. 4A after a plurality of packets have been wrapped onto the mandrel to form a core of desired thickness.
Figure 4A:
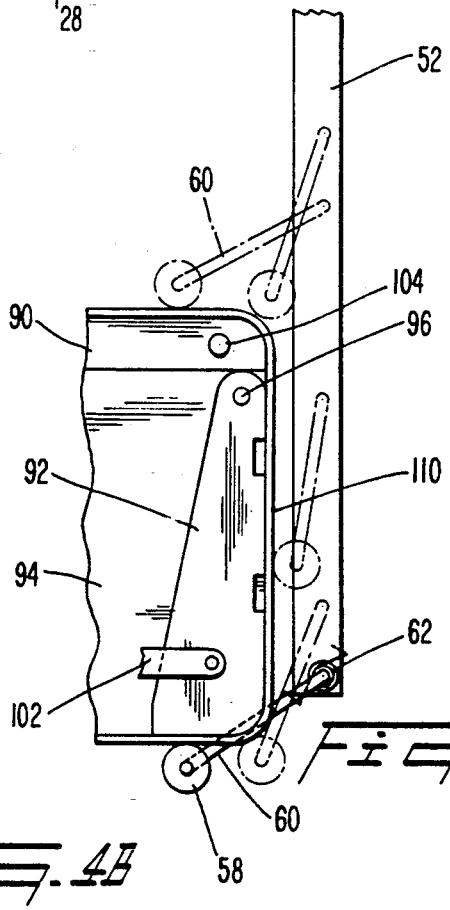
FIG. 4A is a fragmentary end view of a mandrel as a packet of core strips is being wrapped thereon, with various positions of the roller wipers being depicted in phantom.

Once the packet has been formed on the platform 22, the platform is laterally displaced by the ram 30 (see FIG. 3) to a position situated beneath the mandrel 40. The mandrel is fitted with a base layer 110, and the fluid ram 56 is extended to raise the legs 52 which carry the rollers 58. The rollers pass upwardly through the gaps 26 formed in the platform table and lift the packet toward the mandrel (see FIG. 8). As the packet is raised, the central section of the packet contacts the bottom 40A of the mandrel, whereupon the roller-carrying arms 60 yield against the bias of their torsion springs 62, to enable the rollers to follow the contour of the outer periphery of the mandrel as the legs 52 continue to be raised (see FIGS. 4A and 9).

The strength of the springs 62 can be made to simply hold the packet in place, or to aid in pressing the packet to form a core of desired density.

As the rollers wrap the packet around the mandrel, the side pressure pads 76 are extended by the rams 78 to hold the packet against the mandrel. The corner pressure pads 68 function in a similar manner. Eventually, the rollers 58 reach an upper position (see FIG. 10) at which the ends of the packet form a joint.

At this point, the rollers 58 begin a return movement to receive the next packet. As the rollers 58 leave their uppermost position, the upper pressure pad 72 is lowered to hold the ends of the packet in place. Also, the corner pressure pads are momentarily retracted by their rams 70 in order to accommodate the return travel of the rollers. The side pressure pads 76 are then also momentarily retracted for the same purpose.

In the event that the next packet is already positioned beneath the mandrel, the carrier 48 can be retracted (i.e., moved to the right in FIG. 3) by the fluid ram 50 to allow the rollers to assume a position below the packet. By then extending the carrier 48, the rollers will become positioned beneath the packet in preparation for a subsequent wrapping step.

The location of the stop 32 will have been changed following the wrapping of a previous packet, whereby the leading end of the packet will be situated at a position relative to the mandrel which is different than the position of the preceding packet. Accordingly, when the packet is wrapped, its ends will form a joint at a location which is offset relative to that of the previously wrapped packet in order to form a joint pattern of desired configuration.

As the subsequent packet 19 is being raised the side, corner, and upper pressure pads 76, 68 and 72 are successively momentarily retracted in order to accommodate passage of the packet and rollers.

It will be appreciated that the operation of the rollers, the stop 32 and the pressure pads can be controlled by an appropriately programmed computer mechanism.

Once a core of desired thickness has been formed, a band 80 (see FIG. 4B) is wrapped around the core and buckled in conventional fashion.

With the core now ready to be removed from the mandrel, the actuator bar 98 is rotated to cause the side plates of the mandrel to be swung toward one another, thereby collapsing the periphery of the mandrel. As a result, the lifting pins of a lifting mechanism (not shown) can be inserted into the outer ends of the holes 106 of the top plate of the mandrel in order to grip that top plate. The mandrel can now be removed and transported to a suitable station for further treatment. Thereafter, a new top plate 90 is inserted onto the mandrel the side plates 92 are extended to their non-collapsed position, and the next core-wrapping step is performed in the above-described manner.

It will be appreciated that the present invention eliminates certain disadvantages associated with prior art core-forming techniques which involve the deforming of a core, or the use of rotating mandrels.

In accordance with the present invention, there is produced a tightly formed core having a more uniform tensile stress in each of the strips of which the core is formed. Also, the core is characterized by uniform interlaminar compressive stresses, a properly assembled joint pattern capable of subsequently being opened and re-closed after heat treatment, and no extra build-up in the joint region. The present invention may reduce the time and temperature required for the subsequent stress relief heat treatment.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for making a transformer core, comprising:

a stationary mandrel having a non-circular cross sectional perimeter, said mandrel being collapsible to facilitate the removal of a core therefrom, a preformed base layer of stiff material in contact with said mandrel perimeter to form a surface upon which packets of amorphous metal alloy core strips are wrapped, positioning means for positioning a packet of amorphous metal alloy core strips adjacent said mandrel, wrapping means for urging a section of said packet against said base layer surface and wrapping a remaining section of said packet around said non-circular perimeter, so that opposite ends of said packet form a joint, and holding means for holding said packet against said base layer surface while said wrapping means receives successive packets from said positioning means.

2. Apparatus according to claim 1, wherein said mandrel comprises a top portion and collapsible side portions, said top portion being removable from said side portions along with a core.

3. Apparatus according to claim 2, wherein said side portions are pivotable toward and away from one another, and including means for effecting such pivoting movement.

4. Apparatus according to claim 1, wherein said wrapping means comprises yieldably biased elements which follow the contour of said mandrel periphery while pressing a packet thereagainst.

5. Apparatus according to claim 4 including yieldable means biasing said elements to a rest position.

6. Apparatus according to claim 5, wherein said biasing means comprises spring means.

7. Apparatus according to claim 4, wherein said yieldably biased elements comprise rollers.

8. Apparatus according to claim 1, wherein said wrapping means comprises vertically movable support means, a pair of spring biased arms pivotably mounted on said support means, and rollers rotatably carried by said arms and engageable with an underside of a packet, said rollers being yieldable against said spring bias for following the contour of said perimeter while pressing the packet thereagainst.

9. Apparatus according to claim 1, wherein said holding means comprise pressure pads movable against said packet.

10. Apparatus according to claim 9 including means for momentarily retracting said pressure pads away from a wrapped packet to permit return passage of said wrapping means for receiving successive packets to be wrapped.

11. Apparatus according to claim 9, wherein said pressure pads include concavely curved pressuring surfaces for pressing against corner regions of the packet.

12. Apparatus according to claim 1, wherein said positioning means comprises means defining a support surface which is interrupted to permit passage of said wrapping means.

13. Apparatus according to claim 12, wherein said positioning means comprises means defining a support surface, and an adjustable stop for determining the orientation of a packet on said support surface.

14. Apparatus according to claim 1, wherein said mandrel perimeter is of quadrilateral shape.

15. Apparatus according to claim 1, wherein said wrapping means comprises two yieldably biased rollers which follow the contour of said mandrel periphery while pressing a packet thereagainst, and said holding means comprise pressure pads movable against the packet, and means for momentarily retracting said pressure pads away from the packet to permit return passage of said rollers to receive successive packets.

16. Apparatus according to claim 15, wherein said positioning means comprises means defining a support surface and an adjustable stop for determining the orientation of a packet on said support surface.

17. Apparatus for making a transformer core having a quadrilateral cross-section, comprising:

means for forming a packet of amorphous metal core strips, a stationary, collapsible mandrel having a cross-sectional perimeter of quadrilateral shape with curved corner regions, means for locating the packet beneath said mandrel, wrapping means for wrapping packets of amorphous metal core strips comprising:

means for lifting the packet against a bottom of the mandrel, a pair of rollers yieldably biased to a neutral position suitable for engaging an underside of the packet, means for raising said rollers from a lower position to an upper position whereby said rollers follow the contour of said mandrel periphery to wrap the packet therearound so that opposite ends of the packet form a joint, holding mean having pressure pads movable into engagement with the wrapped packet to hold the packet against the mandrel, said holding means including pressure pads with concavely curved pressing surfaces for pressing against at least two corner regions of the wrapped packet, means for returning said rollers to said lower portion to receive successive packets, and retracting means for momentarily retracting said pressure pads to permit said return travel of said rollers to said lower position, and collapsing means for collapsing said mandrel to facilitate the removal of a core which has attained a desired thickness.

18. Apparatus according to claim 17, wherein said mandrel comprises a top portion and collapsible side portions, said top portion being removable from said side portions along with a core.

19. Apparatus according to claim 17 including a preformed base layer of stiff material extending around said mandrel periphery to form a surface upon which the packets are wrapped.

20. Apparatus according to claim 17 wherein said means for locating the packet is arranged to position the packet so that the joint formed by the packet ends comprises a butt-type joint.

21. Apparatus according to claim 17 wherein said means for locating the packet is arranged to position the packet so that the joint formed by the packet ends comprises an overlapped-type joint.

22. Apparatus according to claim 17 wherein said means for locating the packet is arranged to position the packet so that the joint formed by the packet ends comprises a gapped-type joint.

23. Apparatus according to claim 17 wherein said means for locating the packet is arranged to position successive packets so that the joints formed by the ends of successive packets comprise a combination of at least two joints selected from a group consisting of butt-type joints, overlapped-type joints and gapped-type joints.

* * * * *